US006941704B2

(12) United States Patent
Chen et al.

(10) Patent No.: US 6,941,704 B2
(45) Date of Patent: Sep. 13, 2005

(54) DEPLOYABLE STRUCTURE

(75) Inventors: Yan Chen, Oxford (GB); Zhong You, Oxford (GB)

(73) Assignee: Isis Innovation Limited, Summertown (GB)

( * ) Notice: Subject to any disclaimer, the term of this patent is extended or adjusted under 35 U.S.C. 154(b) by 0 days.

(21) Appl. No.: 10/373,204

(22) Filed: Feb. 26, 2003

(65) Prior Publication Data

US 2004/0120758 A1 Jun. 24, 2004

(30) Foreign Application Priority Data

Dec. 19, 2002 (GB) ..... 0229599

(51) Int. Cl.[7] ..... E04B 1/12

(52) U.S. Cl. ..... 52/79.5; 52/63; 52/81.1; 135/128; 135/143

(58) Field of Search ..... 52/79.5, 63, 80.1, 52/81.1, 81.2; 135/128, 131, 143, 145

(56) References Cited

U.S. PATENT DOCUMENTS

| | | | | | |
|---|---|---|---|---|---|
| 639,634 | A | * | 12/1899 | Valiant | 135/88.03 |
| 3,559,353 | A | * | 2/1971 | Partridge | 135/131 |
| 3,710,806 | A | * | 1/1973 | Kelly et al. | 135/145 |
| 4,026,313 | A | * | 5/1977 | Zeigler | 135/143 |
| 4,156,433 | A | * | 5/1979 | Beaulieu | 135/145 |
| 4,437,275 | A | | 3/1984 | Zeigler | |
| 5,024,031 | A | | 6/1991 | Hoberman | |
| 6,141,934 | A | * | 11/2000 | Zeigler | 52/646 |
| 6,148,835 | A | * | 11/2000 | Rhee | 135/145 |
| 6,206,020 | B1 | * | 3/2001 | Lynch | 135/128 |
| 6,230,727 | B1 | * | 5/2001 | Chen | 135/98 |
| 6,343,441 | B1 | * | 2/2002 | Merz et al. | 52/66 |
| 6,470,902 | B1 | * | 10/2002 | Carter | 135/145 |

FOREIGN PATENT DOCUMENTS

| | | |
|---|---|---|
| GB | 1 530 455 | 11/1978 |
| GB | 2 000 207 A | 1/1979 |

OTHER PUBLICATIONS

Baker, E.J. (1979), The Bennett, Goldberg and Myard Linkages—in perspective, *Mechanism and Machinery Theory*, 14, 239–253.

Baker, E.J. (1988), the Bennett linkage and its associated quadric surfaces, *Mechanism and Machine Theory*, 23(2), 147–156.

Baker, E.J. (2000), On the motion geometry of the Bennett linkage, *Mechanism and Machine Theory*, 35, 1641–1649.

Baker, E.J. (2001), The axodes of the Bennett linkage, *Mechanism and Machine Theory*, 36, 105–116.

Baker et al (1986), On spatial networks of overconstrained linkages, *Mechanism and Machine Theory*, 21(5), 427–437.

Bennett, G. T. (1903), a new mechanism, *Engineering* 76, 777–778.

(Continued)

*Primary Examiner*—Brian E. Glessner
*Assistant Examiner*—Basil Katcheves
(74) *Attorney, Agent, or Firm*—Nixon & Vanderhye P.C.

(57) ABSTRACT

A deployable structure includes a structural mechanism consisting of a plurality of rigid links 1 connected together by rotational joints 2 to form an array of Bennett linkages 20. The Bennett linkages 20 are interconnected so that the structural mechanism, including all the Bennett linkages 20, has a single degree of mobility. The structural mechanism has a profile with a curvature that varies during movement to deploy the structure from a state in which its profile is flat to a state in which its profile is curved. This allows is very convenient as the structure may be assembled, stored and/or transported in the flat state, prior to deployment into the curved state. As such the structure has many application including the frame for a tent.

22 Claims, 8 Drawing Sheets

OTHER PUBLICATIONS

Bennett, G. T. (1914), The skew isogram mechanism, *Proceedings of London Mathematics Society 2s*, 13, 151–173.
Goldberg, J. (1943), New five–bar and six–bar linkages in three dimensions, *Trans. A.S.M.E.* 65, 649–663.
Ho, C.Y. (1978), Note on the existence of Bennett mechanism, *Mechanism and Machine Theory*, 13(.), 269–271.
Huang, C. (1977), The cylindroid associated with finite motions of the Bennett Mechanism, *Journal of Engineering for Industry, Trans. A.S.M.E.* 119, 521–524.
Perez et al (2000), Dimensional synthesis of Bennett linkages, *Proceedings of DETC00, 2000 ASME Design Engineering Technical Conferences*, Sep. 10–13, 2000, Baltimore, Maryland.
Savage, M. (1972), Four–link mechanisms with cylindric, revolute and prismatic pairs, *Mechanism and Machine Theory*, 7, 191–120.
Waldron, K. J. (1968), Hybrid overconstrained linkages, *Journal of Mechanisms* 3, 73–78.
Waldron, K. J. (1969), Symmetric overconstrained linkages, *Trans. ASME, Journal of Engineering for Industry*, B91, 158–164.
Yu, H–C (1981), The Bennett linkage, its associated tetrahedron and the hyperboloid of its axes, *Mechanism and Machine Theory* 16, 105–114.
Yu et al (1981), On the generation of new linkages from Bennett loops, *Mechanism and Machine Theory*, 16(5), 473–485.
Langbecker, T. (1999), Kinematic analysis of deployable scissor structures, *International Journal of Space structures* 14(1), 1–15.
Watanabe et al (1996), Module composition and deployment method on deployable modular–mesh antenna structures, *Acta Astronautica* 39(7), 497–505.
You et al (1996), Foldable bar structures, *Int. J. Solids Structures*, 34(15), 1825–1847.
You et al (1993), Foldable ring structures, *Space Structures* 4, 1, Ed. Parke G.A.R. and Howard, C.M. Thomas Telford, London, 1993, 783–792.
Clarke, R.C. (1984), The kinematics of a novel deployable space structural system. *Proceedings of the 3rd International Conference on Space Structures, Surrey, UK.* 79–91, Elsevier Applied Science Publishers.
Escrig et al (1987), Curved expandable space grids, *Proceedings of the International Conference of Design and Construction of Non–conventional Structures* (Ed. Topping, B.H.V.), 157–166, Civil–Comp Press.
Gantes et al (1989), Structural analysis and design of deployable structures, *Computer and Structures*, 32(3/4), 661–669.
Chen et al (2001), Deployable structural element based on Bennett linkages, *2001 American Society of Mechanical Engineers International Congress*, 11–15, Nov., 2001, New York.
Chen et al (2001), Network of Bennett linkages as deployable structures, *AIAA 2001–4661, AIAA Space 2001 Conference and Exposition*, 28–30, Aug. 2001, Albuquerque, U.S.A.

* cited by examiner

Fig.19.
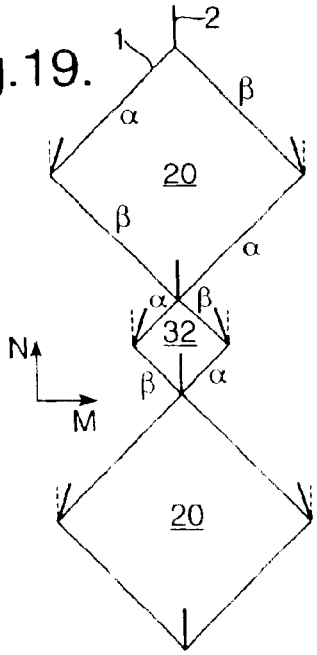
Fig.20.
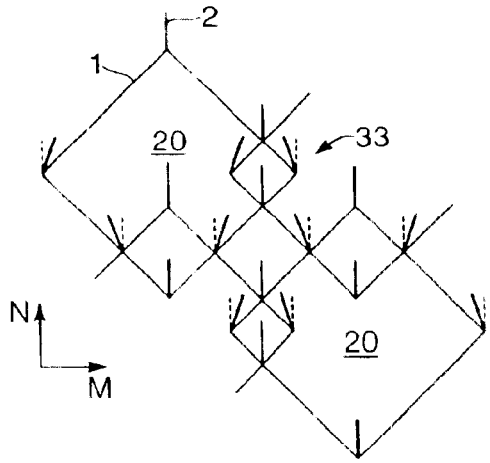
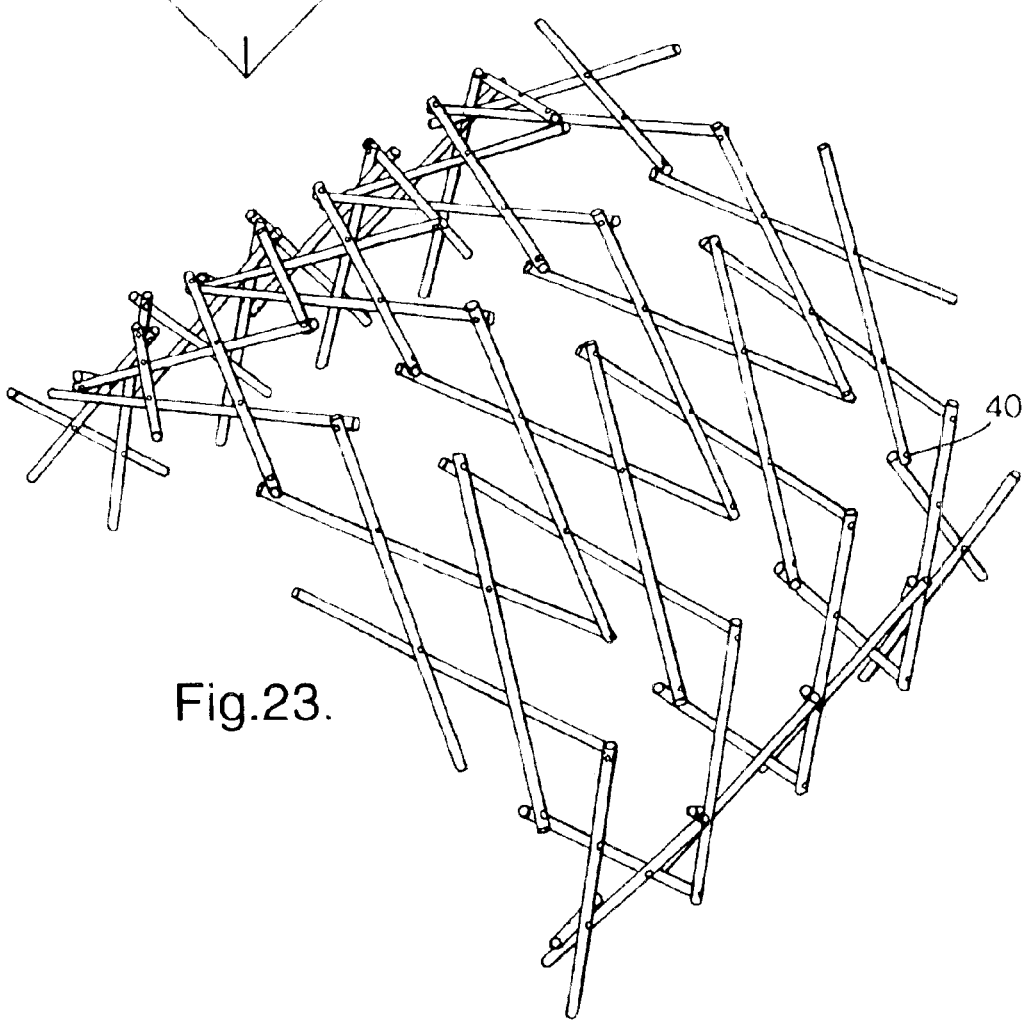
Fig.23.

DEPLOYABLE STRUCTURE

BACKGROUND OF THE INVENTION

The present invention relates to deployable structures which include a structural mechanism which is movable for deployment of the structure. A structural mechanism is a mechanism which is mobile without inducing any strain on its components. The deployable structures of the present invention may be used as structures in a wide range of engineering applications ranging from small structures to large ones, for example in aerospace applications. They are particularly, but not exclusively, applicable as frames for tent-like structures.

In general, a structural mechanism may have any number of degrees of mobility, that is degrees of freedom. The present invention relates to the use of a structural mechanism having a single degree of mobility. In general, the advantage of such a single mobility system is that it is much easier to control and therefore more reliable. Having a single degree of mobility avoids the need for complex operations for deployment. Such structural mechanisms having a single degree of mobility, and over-constrained ones in particular, generally have a relatively high stiffness even without the use of latches. These advantages of easy deployment into a particular state, combined with relatively high stiffness in the resultant deployed state, make structural mechanisms particularly useful. Structural mechanisms have particular use to date as precision aerospace structures.

On the other hand, having a single degree of mobility means that any particular structural mechanism can only be deployed in one way. Thus, the configuration on deployment is limited by the design of the structural mechanism itself. Therefore, the utility of structural mechanisms in general is limited by the knowledge of constructions having particular configurations in their undeployed and deployed states.

A number of structural mechanisms are known based on the use of two-dimensional mechanisms as basic elements which are assembled together. To design such structural mechanisms, a suitable two-dimensional mechanism must be identified, together with a construction technique allowing the basic elements to be assembled whilst retaining mobility of each of the basic elements.

An aim of the present invention is to provide a new and useful form of structural mechanism.

According to the present invention, there is provided a deployable structure including a structural mechanism based on Bennett linkages as a basic element.

A Bennett linkage is a three-dimensional, over-constrained linkage consisting of four rigid links connected together in a loop by rotational joints. Each joint connects two links in the loop and provides for rotation of the connected links about an axis of rotation. Bennett linkages are in themselves known. Indeed they were discovered almost a century ago. They are remarkable in that they consist of only four links and yet are mobile by virtue of the joints having axes of rotation in particular directions which are neither parallel nor concurrent.

On movement of a Bennett linkage, the links move in three dimensions. In particular, if one considers the four links as two opposed pair of connected links, movement of the Bennett linkage causes the opposed pairs of links to relatively rotate about an imaginary line through the opposed joints connecting together the two opposed pairs of links. At the same time, those opposed joints move towards or away from each other. Such relative rotation may be visualised by considering the Bennett linkage observed from a position in line with the two opposed joints which connect the two opposed pairs of links.

Bennett linkages have fascinated and challenged kinematicians. However, research to date on Bennett linkage has been concentrated mainly on the design of small linkages based on a Bennett linkage, for example linkages having five or six links.

SUMMARY OF THE INVENTION

The present invention is a structural mechanism consisting of a plurality of rigid links connected together by rotational joints to form an array of Bennett linkages which are interconnected so that the entire structural mechanism, including all the Bennett linkages, has a single degree of mobility.

The interconnection may be achieved in various ways, but preferably as follows. Respective pairs of Bennett linkages may be interconnected by two connective links of each of the interconnected Bennett linkages being connected together by respective rotational joints so that the two connected links of each of the interconnected Bennett linkages are connected in a loop to form an intermediate Bennett linkage. The interconnected and intermediate Bennett linkages remain mobile provided that certain conditions are met, as described in more detail below. Thus, both interconnected Bennett linkages have a single degree of mobility, and consequently the entire structural mechanism has a single degree of mobility through the interconnection of the individual Bennett linkages.

The Bennett linkages are interconnected so that the structural mechanism has a profile with a curvature that varies during movement of the mechanism. This may be achieved by certain conditions on the intermediate linkage linking the Bennett linkages, which will be described in more detail below.

The interconnection along the direction in which the curvature of the profile of the structural mechanism occurs is now explained, based on a consideration of the movement of a Bennett linkage as causing two opposed pairs of links to rotate relative to one another. The interconnection causes the relative rotation of each Bennett linkage to be additive as one progresses along the structural mechanism. This in turn causes the profile of the structural mechanism to curve.

The curvature of the profile of the structural mechanism may be visualised by considering the interconnection between one pair of links of one of the interconnected Bennett linkages with one of the pairs of links of the other interconnected Bennett linkage. The individual Bennett linkages are arranged such that movement of the structural mechanism causes relative rotation of the two opposed pairs of links of each individual Bennett linkage to occur in the same sense. At the same time, the intermediate linkage may either cause no relative rotation of the pairs of links of the interconnected Bennett linkages or may cause additional rotation in the same sense (or even in the opposite sense but by a different amount). Thus the net effect is for the profile of the structural mechanism to have a changing curvature.

The structural mechanism may consist of a single series of Bennett linkages interconnected together. Alternatively, perpendicular to the direction in which the profile curves, the structural mechanism may comprise rows of Bennett linkages interconnected together. In this case, the Bennett linkages are interconnected so that the rows remain straight. This is achieved by use of an intermediate linkage which maintains each of the Bennett linkages in any individual row in the same orientation in three dimensions.

Consequently, the present invention provides a deployable structure including a structural mechanism which may be deployed in to a state in which its profile is curved. Furthermore, in the direction along the axis of curvature, the profile of the structural mechanism is straight. As the curvature varies during deployment, in another state, which may be taken as the undeployed state, the structural mechanism may have a flat profile.

This provides a very convenient structure which may be assembled, stored and/or transported in a flat state prior to deployment into a curved state. In particular, the deployable structure in accordance with the present invention has the following advantages. As the structural mechanism consists solely of rigid links and rotational joints, it is easy to manufacture and assemble and maintain. The links may be very simple in construction and in fact regular mechanisms may consist of identical links. Similarly, it is possible to use simple joints which are easy to manufacture, because the joints simply provide for relative rotation of the links.

As the structural mechanism may be collapsed flat, it is easily packed prior to deployment. Similarly, the structural mechanism may easily be segmented for packing, due to its simple nature. In its deployed state with a curved profile, the structural mechanism provides an open interior volume on the inside of the curve. Around this internal volume, the structural mechanism may be formed as a single layer of rigid links interconnected together. This allows the structure in its deployed state to provide a frame around a relatively large interior volume. At the same time, the open nature of the structural mechanism causes the weight to be relatively low.

Also, the over-constrained nature of the structural mechanism provides a high degree of stiffness and structural strength. In particular, the structural mechanism can withstand failure of one or more of the links and/or joints.

These advantages make the deployable structure very useful for a wide range of engineering applications over a wide range of scales. The deployable structures may have a small size, limited only by the need to form a rotational joint between the link. Conversely, the structural mechanism may be formed with a much larger size, for example as a structure for a building or in an aerospace application.

A particularly advantageous use of the present invention is as the frame for a tent. In this case, the structural mechanism is used to support flexible material. In use as a tent, the ease and speed of deployment is a particular advantage.

Preferred embodiments of the present invention will now be described by way of non-limitative example with reference to the accompanying drawings.

DESCRIPTION OF THE DRAWINGS

In the drawings:

FIG. 19 is a schematic view of two Bennett linkages of the structural mechanism connected along the minor direction N with an alternative intermediate linkage;

FIG. 20 is a schematic view of two Bennett linkages of a structural mechanism connected along the minor direction N with a further alternative linkage;

FIGS. 23 and 24 are perspective views of the structural mechanism of FIG. 22 in successive curved states.

DETAILED DESCRIPTION OF THE PREFERRED EMBODIMENTS

Deployable structures which constitute the preferred embodiments are constructed as follows. The deployable structures include a structural mechanism consisting of a plurality of rigid links 1 connected together by rotational joints 2, for example the alternative joints 2 illustrated in cross-section in FIGS. 1A and 1B, respectively.

The rigid links 1 may have any structural form. By "rigid" it is meant that the links are sufficiently rigid to maintain the single degree of mobility of the structural mechanism. In fact, in any give application, the links 1 will inevitably have some degree of flexibility. The links 1 may be simple cylindrical bars as illustrated in FIG. 1. However, the links may have any cross-section. In the structural mechanisms described below, the links 1 are straight, but in principle they may equally be curved.

Figure 1A:
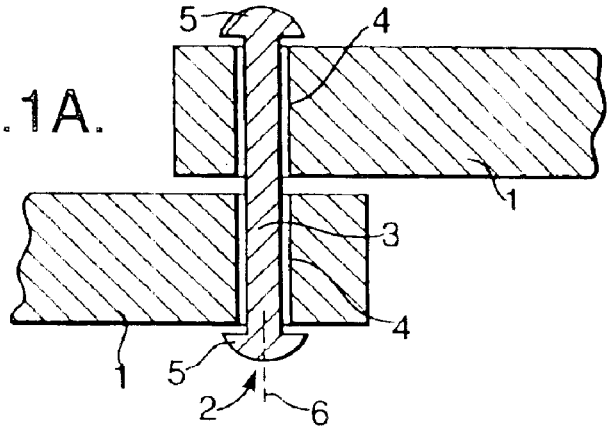
FIGS. 1A and 1B are cross-sectional views of respective, alternative joints connecting two links.
Figure 1B:
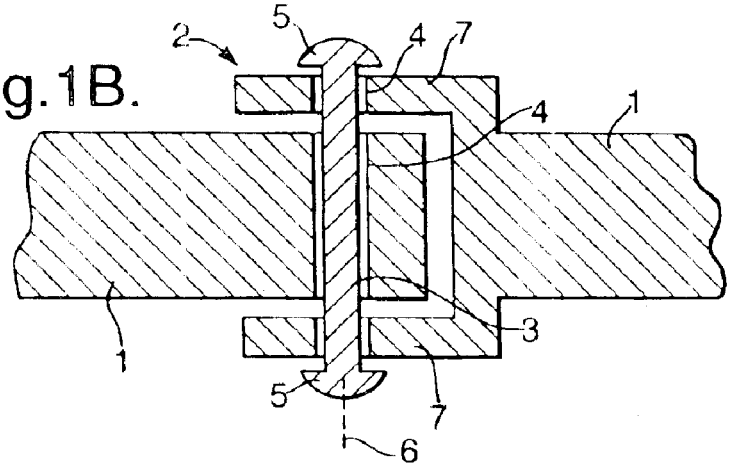

The joints 2 connecting the links 1 provide for relative rotation of the two links 1 connected by the joint 2 about an axis of rotation 6. In the examples of FIGS. 1A and 1B, the joints 2 are formed by a pin 3 extending through bores 4 in each of the connected links 1. Thus, each link 1 is constrained to rotate around the pin 3. The pin 3 has enlarged heads 5 at both ends to retain the pin 3 in place. For example, the enlarged heads 5 may be formed by rivetting. In the joint 2 of FIG. 1A, the links 1 are arranged side-by-side, that is they are not co-axial. In the joint 2 of FIG. 1B, the links 1 are arranged to be co-axial by means of one of the links 1 having a pair of arms 7 arranged on either side of the other link 1, so that the arms 7, together with the end of the link 1 from which they protrude, extend around the end of the other link 1. In this case, the bore 4 is formed in the arms 7.

In the examples of FIGS. 1A and 1B, the axis of rotation 6 is perpendicular to the links 1 which are themselves straight, but in general this is not essential, as will be described in more detail below.

The particular forms of the joint 2 shown in FIGS. 1A and 1B are merely given by way of example and in principle any joint which provides for relative rotation of the links 1 may be used. For example, the joint could have a more complicated structure than the joint 2 of FIG. 1 or could be formed integrally with both the links 1.

The structural mechanism consists of a plurality of rigid links 1 connected by joints 2 to form an array of interconnected Bennett linkages. To assist in understanding, there will first be described a single Bennett linkage 10 which is illustrated schematically in perspective view in FIG. 2. The Bennett linkage 10 comprises four links 1 connected in a loop by joints 2. The positions of the joints 2 are labelled A, B, C, D for ease of reference.

Figure 2:
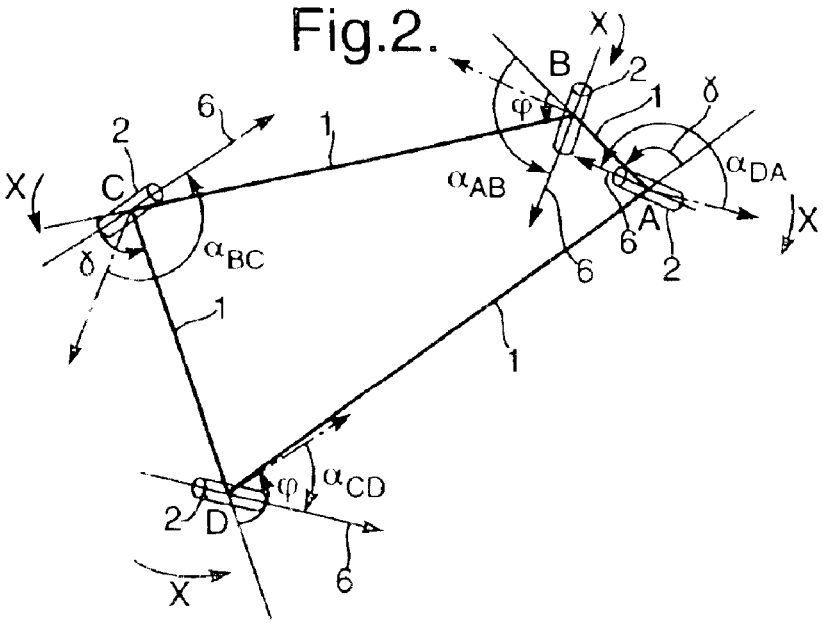
FIG. 2 is a perspective view of a Bennett linkage.

Each joint 2 connects two links 1 and provides for relative rotation of those two links 1 about an axis of rotation 6. Considering any individual link 1, the axes of rotation 6 of the joints connecting that link 1 are skewed relative to each other around an imaginary line perpendicular to the axes of rotation 6 of both joints 1. In the Bennett linkage 10 of FIG. 2, that imaginary line is along the links 1 because each link 1 extends perpendicular to the axes of rotation 6 of the two joints 2 connecting the particular link 1 (although this is not essential, as described below). The skew of the joints 2 connected to a given link may be defined by reference to a skew angle for that link 1. Herein, the skew angles are measured progressing in the same sense around this Bennett linkage 10. Thus, the skew angles for the four links 1 are illustrated in FIG. 2 by the angles $\alpha_{AB}$, $\alpha_{BC}$, $\alpha_{CD}$ and $\alpha_{DA}$, resptively.

The axes of rotation 6 of the two joints 2 connecting each respective link 1 are non-parallel and non-intersecting. That being said, if the axes of rotation 6 of each of the joints 2 were parallel, then the linkage would be a plain parallelogram, or a plain-crossed isogram, with a single degree of freedom. Such arrangements may be considered as a special case of a Bennett linkage.

Another point to bear in mind is that since the axes of rotation 6 do not have a direction, then a link 1 having a skew angle of θ has joints 2 with identical axes of rotation 6 to a link 1 having a skew angle of (180°−θ). Herein, skew angles will be defined by an angle between 0 and 180°, whereby the sine of the angle will always take a positive value.

The mobility conditions for the Bennett linkage 10 are as follows. Firstly, the length of opposite links 1 must be equal, i.e.

$$\overline{AB}=\overline{DC}=a \tag{1}$$

$$\overline{BC}=\overline{AD}=b \tag{2}$$

Secondly, the skew angles of opposite links 1 must also be equal, i.e.

$$\alpha_{AB}=\alpha_{CD}=\alpha \tag{3}$$

$$\alpha_{BC}=\alpha_{DA}=\beta \tag{4}$$

Thirdly, the lengths and skew angles of the links 1 satisfy the following formula, taking the length a of a first pair of opposite links 1, the length b of the second pair of opposite links 1, the skew angle α for the first pair of opposite links 1, and the skew angle β for the second pair of opposite links 1:

$$\frac{\sin\alpha}{a}=\frac{\sin\beta}{b} \tag{5}$$

In general, the length a of the first pair of opposite links 1 can take any value with respect to the length b of the second pair of opposite links 1, provided this condition is met.

However, it is preferable for structural mechanisms in accordance with the present invention for the length of all the links 1 of each Bennett linkage 10 to be identical. In this case, the sum of the skew angle α and β for the two pairs of opposite links 1 is 180°. Incidentally, this is equivalent to the skew angles α and β for the two opposite pairs of bars being of the same magnitude, but opposite signs, using the alternative notation that the skew angles are between −90°and 90°. In other words, in this case, the axes of rotation 6 of each pair of opposite joints 2 (i.e. the pair of joints 2 at positions A and C, or the pair of joints 2 at positions B and D) always lie in a common plane.

Providing these mobility conditions are met, the linkage can move by the pairs of connected links 1 simultaneously rotating relative to each other. If the conditions for mobility are not met, then the Bennett linkage 10 is constrained from moving.

The Bennett linkage moves in three dimensions. Denoting the deployment angles at a joint 2, that is the angles between the connected links 1 (or, in the general case, the angle between the imaginary lines perpendicular to the axis of rotation 6 of the joint 2 in question and the axes of rotation 6 of the adjacent joints 2) at each of the positions A, B, C and D as $\theta_A$, $\theta_B$, $\theta_C$ and $\theta_D$, respectively, the following equations hold:

$$\theta_A=\theta_C=\gamma \tag{6}$$

$$\theta_B=\theta_D=\phi \tag{7}$$

$$\tan\frac{\gamma}{2}\tan\frac{\varphi}{2}=\frac{\sin\frac{1}{2}(\alpha+\beta)}{\sin\frac{1}{2}(\alpha-\beta)} \tag{8}$$

Figure 3:
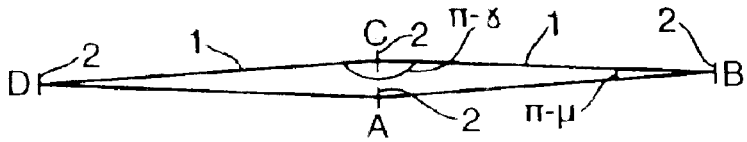
FIG. 3 is a view from above of the Bennett linkage of FIG. 2 in a flat state.
Figure 4:
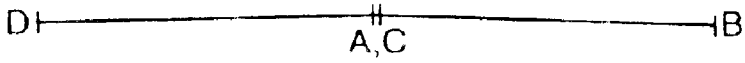
FIG. 4 is a view from the side of the Bennett linkage of FIG. 2 in the flat state.
Figure 5:
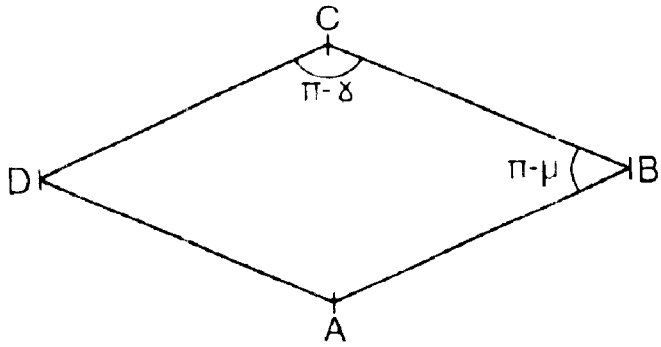
FIG. 5 is a view from above of the Bennett linkage of FIG. 2 after movement into a bent state.
Figure 6:
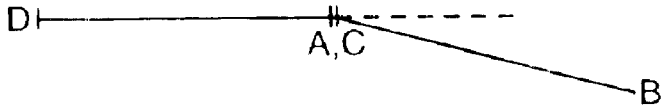
FIG. 6 is a view from the side of the Bennett linkage of FIG. 2 after movement into the bent state.

The movement will now be described with reference to FIGS. 3 to 6. FIGS. 3 and 4 are views of the Bennett linkage 10 in a flat state and FIGS. 5 and 6 which are views of the Bennett linkage 10 moved into a bent state. FIGS. 3 and 5 are similar views of the Bennett linkage 10 taken from the side along the direction in which two of the joints 2 at positions A and C are aligned, whereas FIGS. 4 and 6 are views of the Bennett linkage 10 from above. FIGS. 3 to 6 illustrate the case that the Bennett linkage 10 is equilateral, but fundamentally the same motion is observed if the two pairs of opposite links 1 are of different lengths.

In the flat state of FIGS. 3 and 4, the deployment angle γ at the joints 2 at positions A and C approaches 0°. Thus, the deployment angle ϕ at the other joint 2 at positions D and B approaches 180°. In this case, the joints 2 at positions A and C are close to each other, and the pair of links 1 connected at position B lie adjacent one another, as do the pair of links 1 connected at position D. On movement of the Bennett linkage 10, the four joints move in the directions illustrated by the arrows X in FIG. 2. The deployment angle ϕ increases whilst the deployment angle γ decreases. Simultaneously, the joints 2 at positions A and C move away from each other and the joints 2 at positions B and D move toward each other. The pair of links 1 connected at position B rotate relative to the pair of links 1 connected at position D around an imaginary line through the two opposed joints 2 at positions A and C which connect those two pairs of links 1. This relative rotation may be seen clearly by comparing FIG. 3 and FIG. 5. This relative rotation is important in that it is used to generate curvature in the structural mechanism as a whole, as will be described in more detail below.

A feature of all the structural mechanisms described herein is that each link 1 is straight and perpendicular to the axes of rotation 6 of the joints 2 connecting that link 1. Thus, each joint 2 is formed in each respective link 1 at the intersection of the axis of rotation 6 of the joint 2 with an imaginary line perpendicular to the axis of rotation 6 of that joint 2 and to the axes of rotation 6 of adjacent joints 2. In this case, the length of the links 1 between the joints is the shortest distance between the two axes of rotation 6. However, this is not essential. The present invention applies equally to Bennett linkages in which the links 1 do not extend perpendicularly to the axes of rotation 6 of the joints 2 connecting that link 1.

As a first alternative, the joints 2 may be formed in each respective link 1 at the same position relative to the imaginary lines perpendicular to the axes of rotation 6, but with the links 1 being curved in between.

As a second alternative, the joints 2 may be offset from the intersection of the axis of rotation 6 of the joint 2 with the imaginary lines perpendicular to the axis of rotation 6 of the respective joint 2 and the axes of rotation 6 of the adjacent joints 2 in the Bennett linkage 10. In this case, the actual distance between the two joints 2 connected to a given link 1 is greater than the shortest distance between the two axes of rotation 6 of the joints 2. However, it can be shown that the Bennett linkage 10 remains mobile provided that the length of the imaginary line perpendicular to the axes of rotation 6 of the two joints 2 connecting any link 1 remains the same. In other words, the Bennett linkage 10 remains mobile provided the above mobility conditions are met, taking the length of a link to be the length between the joints 2 connecting that link 1 resolved along the imaginary line. This type of Bennett linkage is in itself known and has the advantage that it can provide for more compact packing of the links 1. For example this type of Bennett linkage is described in Chen and You, "Deployable Structural Element Based On Bennett Linkages", 2001 American Society of Mechanical Engineers International Congress, 11–15 Nov. 2001, New York, U.S.A.

There will now be described structural mechanisms which include a plurality of links connected together to form an array of interconnected Bennett linkages. Each of the Bennett linkages in the structural mechanisms described below is a Bennett linkage 10 as described above with reference to FIG. 2. In particular, each of the Bennett linkages meets the mobility conditions described above. However, in the following description, the various Bennett linkages are given different reference numerals for ease of identification.

Some of the figures referred to in the following description are schematic. In the schematic figures, although the structural mechanism can be moved in to a state in which its profile is curved around an axis of curvature, the structural mechanisms are illustrated in plan view developed onto a flat plane. This view most clearly shows the nature of the interconnection between the various Bennett linkages. Also in the schematic figures, the links 1 are illustrated by the solid lines where the joints 2 are not themselves illustrated, a joint 2 is in fact present at every position where links 1 meet or cross one another.

Figure 7:
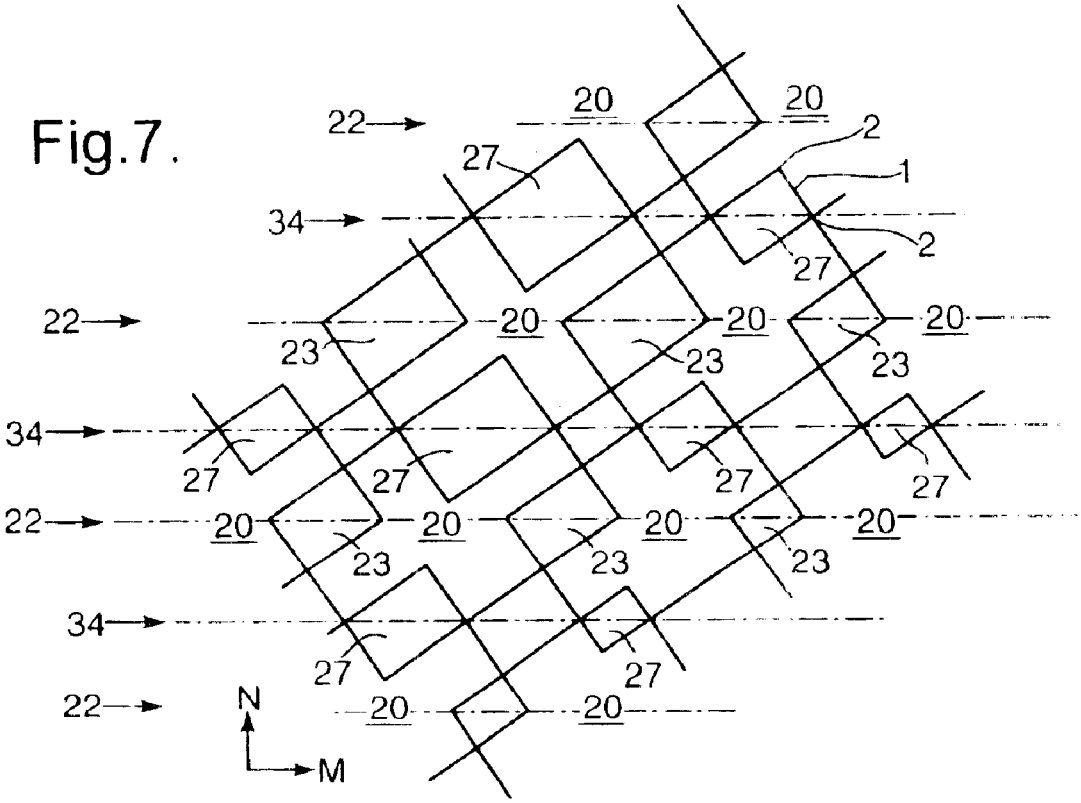
FIG. 7 is a schematic view of a portion of a structural mechanism.

FIG. 7 is a schematic view of a portion of a first structural mechanism comprising an array of interconnected Bennett linkages 20. FIG. 7 illustrates only a portion of the structural mechanism including four complete Bennett linkages 20 which are interconnected together. Around those four interconnected Bennett linkages 20, parts of eight further Bennett linkages 20 are illustrated to show how the structural mechanism may be developed further. In fact, the structural mechanism of FIG. 7 may be repeated indefinitely in both horizontal and vertical directions to produce a structural mechanism of any desired size.

The Bennett linkages 20 are the larger rectangles (or parts of rectangles) shown in FIG. 7. The Bennett linkages 20 overlap to form smaller rectangles, which are in fact further Bennett linkages or plain parallelogram linkages, as will be described further below. Where the interconnected Bennett linkages 20 cross one another, joints 2 connect the links 1 of the interconnected Bennett linkages 20. All the joints 2 formed in any link 1 of any interconnected Bennett linkage 20 have axes of rotation 6 which are perpendicular to a common imaginary line.

All the interconnected Bennett linkages 20 are arranged in a common orientation.

The various interconnected Bennett linkages 20 may in general be of different sizes. However, for each of the interconnected Bennett linkages 20 the ratio of the lengths of the first and second pairs of opposite links, in corresponding positions in each Bennett linkage 20, is the same for each of the interconnected Bennett linkages 20 and the skew angles of each of the interconnected Bennett linkages 20 is the same for the links in corresponding positions.

The interconnected Bennett linkages 20 are arranged in a series of rows 22. Along each row, the interconnected Bennett linkages 20 are aligned along the same direction as shown by the dotted lines, which directions are parallel for each row 22. Hereinafter, this direction will be referred to as the major direction and will be illustrated by the arrow M. The direction perpendicular to the major direction will be referred to as the minor direction and will be illustrated by the arrow N.

Figure 8:
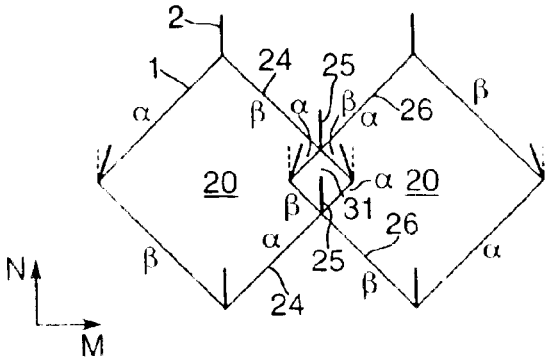
FIG. 8 is a schematic view of two Bennett linkages of the structural mechanism of FIG. 7 connected along the major direction M.

Along the major direction M, the Bennett linkages 20 are interconnected. The nature of the interconnection is illustrated in FIG. 8 which illustrates just two of the interconnected Bennett linkages 20 for clarity. The two interconnected Bennett linkages 20 are connected by an intermediate Bennett linkage 23. Two connected links 24 of one of the interconnected Bennett linkages 20 are each connected by a respective rotational joint 25 to a respective one of two connected links 26 of the other of the Bennett linkages 20. As a result, the two connected links 24, 26 of each of the interconnected Bennett linkages 20 are connected in a loop to form the intermediate Bennett linkage 23.

The intermediate Bennett linkage 23 is mobile with both the interconnected Bennett linkages 20. To achieve such an interconnection, the intermediate linkage 23, as well as meeting the general mobility conditions for a Bennett linkage described above, satisfies the condition that the ratio of the lengths of the first and second pairs of opposite links of the intermediate Bennett linkage 23 are the same as the ratio for the interconnected Bennett linkages 20. In general, to maintain mobility with the interconnected Bennett linkages 20, the intermediate Bennett linkage 23 could have any skew angle $\alpha$ and $\beta$ for the first and second opposite pairs of links. However, in accordance with the present invention, the intermediate Bennett linkage 23 is arranged to maintain the two interconnected Bennett linkages 20 in a straight line. That is to say, the links of the two interconnected Bennett linkages 20 at corresponding positions are maintained parallel to one another. This is achieved by the intermediate Bennett linkage 23 having skew angles which are equal to the skew angles of the corresponding links of the interconnected Bennett linkages 20.

As a result of the interconnection of the Bennett linkages 20 in the rows 22, the entire structural mechanism is constrained to remain straight in the major direction M during movement of the structural mechanism.

Figure 9:
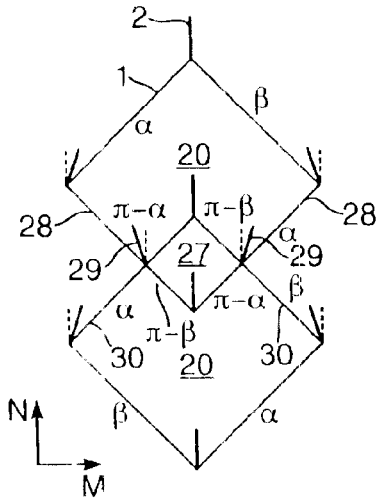
FIG. 9 is a schematic view of two Bennett linkages of the structural mechanism of FIG. 7 connected along the minor direction N.

In the minor direction N, the series of rows 22 of Bennett linkages 20 are interconnected. The nature of the interconnection is illustrated in FIG. 9 which shows just two interconnected Bennett linkages 20 for clarity. In a similar manner to the interconnection along the major direction 21, the two interconnected Bennett linkages 20 are connected along the minor direction N by an intermediate linkage 27. Two connected links 28 of one of the interconnected Bennett linkages 20 are each connected by a respective rotational joint 29 to a respective one of two connected links 30 of the other of the interconnected Bennett linkages 20. Thus, the two connected links 28, 30 of both of the interconnected linkages 20 are connected in a loop to form an intermediate linkage 27.

The intermediate linkage 27 is mobile with both the interconnected Bennett linkages 20. To achieve this, there is a condition on the intermediate linkage 27 that the ratio of the length of the first and second pairs of opposite links is the same for the intermediate linkage 27 as for both of the interconnected Bennett linkages 20.

The intermediate linkage 27 which connects Bennett linkages 20 along the minor direction N has an important difference from the intermediate Bennett linkage 23 which connects Bennett linkages 20 along the major direction M. In particular, the intermediate linkage 27 is arranged to cause the profile of the structural mechanism along the minor direction N to curve. This is achieved as follows.

It is described above how selection of the skew angles of the intermediate Bennett linkage 23 in the major direction M equal to the skew angles of the interconnected Bennett linkages 20 causes the Bennett linkages 20 connected along the major direction M to remain in a straight line. If the intermediate Bennett linkage 27 along the minor direction N has skew angles with any other value then this will cause the profile of the structural mechanism to have a varying curvature along the minor direction N during movement.

In particular, the arrangement of the intermediate linkage 27 generates curvature in the profile of the structural mechanism as follows. It is described above with reference to FIGS. 3 to 6 how movement of a Bennett linkage causes rotation of two opposed pairs of connected links relative to one another by an imaginary line through the opposed joints connecting those two opposed pairs of links. In the structural mechanism of FIG. 7 this imaginary line corresponds to the major direction M. Thus, the relative rotation of the opposed pairs of links in the Bennett linkages 20 of each row 22 occurs in the same sense. The intermediate linkage 27 is arranged to cause that relative rotation within the Bennett linkages 20 of each row 22 to be additive as one progresses along the minor direction N. This causes the profile of the structural mechanism to curve.

The curvature is a property of the overall profile of the structural mechanism. As the individual links 1 are rigid, they cannot themselves bend. However, the manner in which they are interconnected causes curvature in the overall profile and causes the curvature to vary during movement of the links 1. Thus, if one considers a median line along the minor direction N at a median position with respect to the locally positioned links 1, so that the individual links are inclined inwardly and outwardly to give the overall structural mechanism a multi-faceted configuration, then it is that median line which curves.

In general, the intermediate Bennett linkage 27 along the minor direction N may have any skew angle which is not equal to the corresponding skew angle of the interconnected Bennett linkages 20. Some particular skew angles for the intermediate linkage 27 along the minor direction N will now be described.

A first possibility is for the skew angles of the intermediate linkage 27 to be 0°. That is to say all the joints of the intermediate linkage 27 have parallel axes of rotation, whereby the intermediate linkage 27 is a plane parallelogram. In this case, the two interconnected links 28 and 30 of the two interconnected Bennett linkages 20 all remain in a common plane. Thus, the intermediate linkage 27 serves to interconnect the Bennett linkages 20 and to constrain them to have a single degree of mobility together without introducing any curvature along the minor direction N. The curvature along the minor direction N is introduced solely by the relative rotation between the opposed pairs of connected links of each interconnected Bennett linkage 20. No additional curvature is introduced by the intermediate linkage 27.

Figure 10:
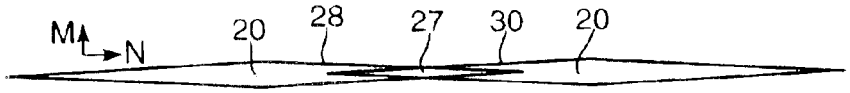
FIGS. 10 to 13 are views, corresponding to those of FIGS. 3 to 6, of two interconnected Bennett linkages interconnected along the major direction M in a first way.
Figure 11:
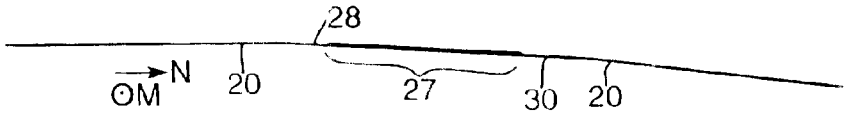
Figure 12:
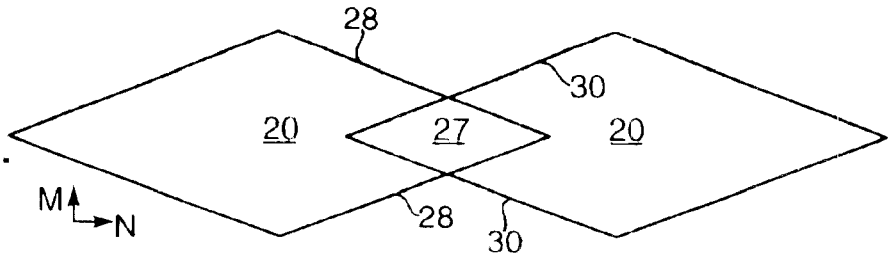
Figure 13:
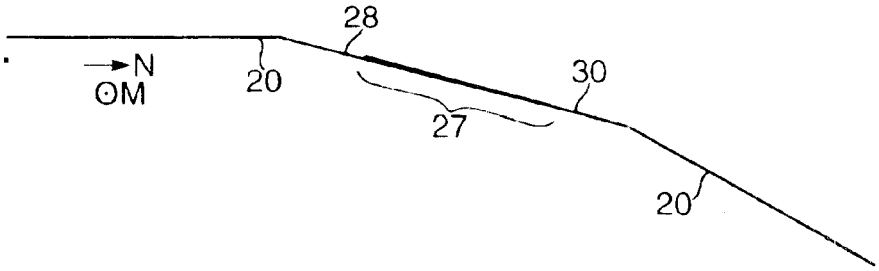

To illustrate the varying curvature during movement of the structural mechanism, movement of the portion of the structural mechanism of FIG. 9 is illustrated in FIGS. 10 to 13. These correspond with the views of FIGS. 3 to 6, except that instead of showing the single Bennett linkage 10, two interconnected Bennett linkages 20 and the intermediate linkage 27 with a skew angle of 0° are shown. As shown in FIGS. 10 and 11, in the flat state, the interconnected Bennett linkages are both substantially aligned along a straight line, thereby giving the structural mechanism a flat profile. As shown in FIGS. 12 and 13, as the structural mechanism moves, the relative rotation between the opposed pairs of connected links of both the interconnected Bennett linkages 20 occurs in the same sense. Thus, the intermediate linkage 27 causes the relative rotation to combine additively along the direction N causing the profile of the structural mechanism to increase in curvature.

A second possibility is for the skew angles of the intermediate linkage 27 to be 180° minus the corresponding skew angles of the interconnected Bennett linkages 20. In this case, the intermediate linkage 27 is a Bennett linkage. It therefore meets the mobility conditions for a Bennett linkage as set out above. The intermediate Bennett linkage 27 serves to interconnect the Bennett linkages 20 and to constrain them to have a single degree of mobility together. Curvature along the minor direction N is introduced by the relative rotation between the opposed pairs of connected links of each interconnected Bennett linkage 20. Additional curvature along the minor direction N is introduced by the intermediate Bennett linkage 27. This results from the skew angles of the intermediate Bennett linkages 27. On movement of the structural mechanism, this skew angle causes relative rotation, within the intermediate Bennett linkage 27, of the pair of connected links 28 of the one Bennett linkage 20 relative to the pair of connected links 30 of the other Bennett linkage 20 around the major direction M. This relative rotation in the intermediate Bennett linkage 27 is in the same sense as the relative rotation of the opposed pairs of connected links within each interconnected Bennett linkage 20.

Thus, the second possibility introduces additional curvature along the minor direction N as compared to the first possibility for the intermediate linkage 27 of having skew angles of 0°.

Figure 14:
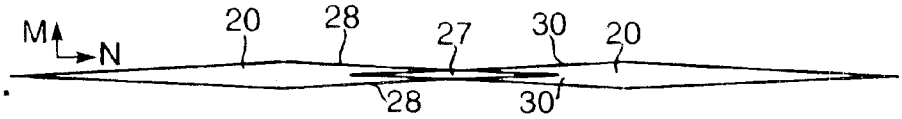
FIGS. 14 to 17 are views, corresponding to those of FIGS. 3 to 6, of two interconnected Bennett linkages interconnected along the major direction M in a second way.
Figure 15:
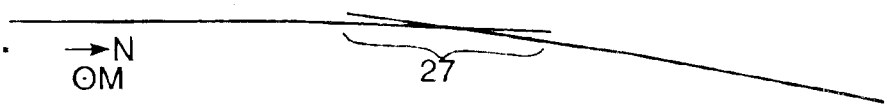
Figure 16:
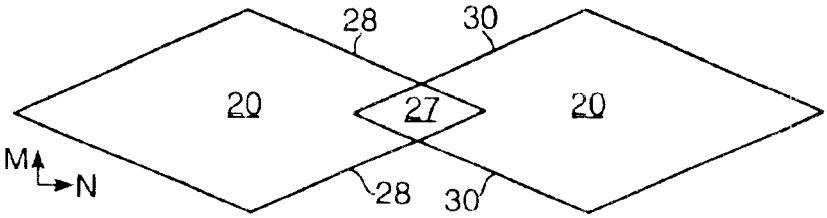

To illustrate the varying curvature during movement of the structural mechanism having the second type of intermediate linkage 27, movement of the portion of the structural mechanism of FIG. 9 is illustrated in FIGS. 14 to 17. These correspond with the views of FIGS. 3 to 6, except that in place of showing the single Bennett linkage 10, the two interconnected Bennett linkages 20 are shown. As shown in FIGS. 14 and 15, in a first state, the interconnected Bennett linkages 20 are both substantially aligned along a straight line, thereby giving the structural mechanism a flat profile. As shown in FIGS. 12 and 13, as the structural mechanism moves, the relative rotation between the opposed pairs of connected links of both the interconnected Bennett linkages 20 curve in the same sense. In addition, it can be seen that the movement of the intermediate linkage 27 causes relative rotation of the pair of connected links 28 of the one Bennett linkage 20 with respect to the pair of connected links 30 of the other Bennett linkage 20. Thus, the intermediate Bennett linkage 27 causes the relative rotation within both the interconnected Bennett linkages 20 and the intermediate Bennett linkages 27 to combine additively along the direction N causing the profile of the structural mechanism to increase in curvature.

Figure 17:
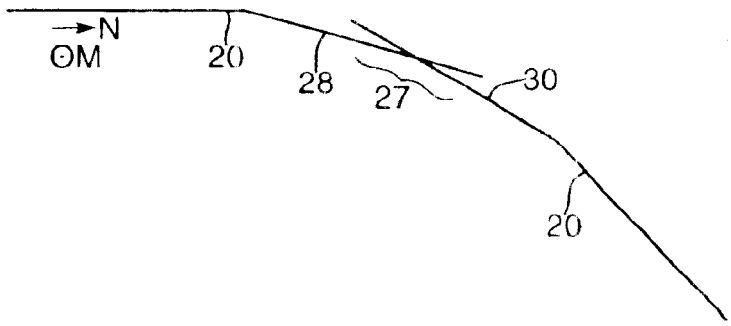

Thus, the advantage of the second form of intermediate Bennett linkage 27 is that it increases the degree of curvature of the profile of the structural mechanism along the minor direction N. On the other hand, it does result in the ends of the Bennett linkages 20 forming the intermediate linkage 27 protruding outwardly from the rest of the interconnected Bennett linkages 20, as can be seen in FIG. 17. Such protrusion can create difficulties in some applications, for example when it is desired to cover the structural mechanism with a flexible material. Therefore, the first form of the intermediate linkage 27 has the advantage of avoiding any such protrusion of the links 28 and 30 forming the intermediate linkage 27.

In contrast to the structural mechanism illustrated in FIG. 7 in which plural Bennett linkages 20 are arranged along each row 22 in the major direction M, a structural mechanism in accordance with the present invention may be formed with only a single Bennett linkage 20 in the major direction M. In such a case, the structural mechanism comprises a series of Bennett linkages along the minor direction N. FIG. 9 may be considered as a schematic diagram of such a structural mechanism comprising two Bennett linkages. In general, the structural mechanism could have any number of Bennett linkages 20 interconnected along the minor direction N.

In the structural mechanisms described above, the interconnected Bennett linkages 20 are interconnected by intermediate linkages 23 and 27 formed inside the Bennet linkages 20 by overlapping those interconnected Bennett linkages 20. However, this is merely one possible form for the intermediate linkages 23 and 27. In general, many other forms of intermediate linkage along both the minor direction N and the major direction M are possible. For example the interconnected Bennett linkages 20 do not need to overlap. Different forms of intermediate linkage may be mixed.

Figure 18:
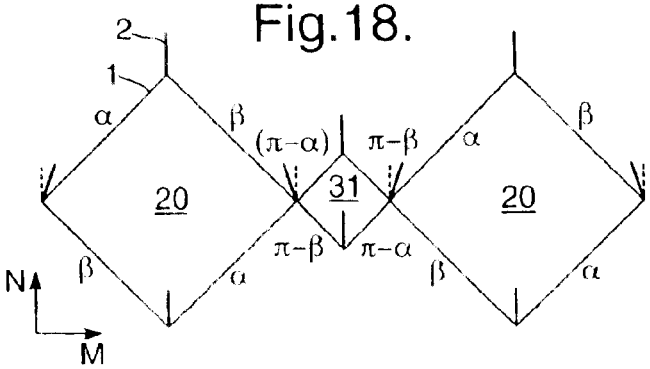
FIG. 18 is a schematic view of two Bennett linkages of a structural mechanism connected along the major direction M with an alternative intermediate linkage.

One simple alternative is to form an intermediate linkage by two connected links of both the interconnected Bennett linkages 20 by respective rotational joints in the same manner as the intermediate linkages 23 and 27 illustrated in FIGS. 8 and 9, but instead extending the link of the interconnected Bennett linkages 20 outside the interconnected Bennett linkages 20 as a result, the intermediate linkage is itself formed outside the interconnected Bennett linkages 20. FIGS. 18 and 19 illustrate such intermediate linkages 31 and 32, respectively, outside the interconnected Bennett linkages 20 along the major direction M and the minor direction N, respectively. In FIG. 18 the intermediate Bennett linkage is labelled 31 and in FIG. 19 the intermediate linkage is labelled 32. The above comments made about the intermediate linkages 23 and 27 apply equally to the intermediate linkages 31 and 32 formed outside the interconnected Bennett linkages 30, except that the skew angles of the intermediate linkages 31 and 32 formed outside the interconnected Bennett linkages 20 are 180° minus the skew angles of the intermediate Bennett linkages 23 and 27, respectively, formed inside the interconnected Bennett linkages 20. Thus, in the case of the intermediate Bennett linkage 31 formed along the major direction M, the skew angles which are equal to 180° minus the corresponding skew angles of the interconnected Bennett linkages 20. Similarly, the intermediate Bennett linkage 32 along the minor direction N has skew angles which are, in general, not equal to 180° minus the corresponding skew angles of the interconnected Bennett linkages 20.

Another simple form for the intermediate linkage along the minor direction N is for two connected links of one of the interconnected Bennett linkages to also constitute connected links of the other of the interconnected Bennett linkages, whereby the joint connected to those connected links is common to both the interconnected Bennett linkages. FIG. 19 may be considered as an example of this if one considers the intermediate Bennett linkage 32 to be instead one of the interconnected Bennett linkages, so that FIG. 19 consists of three interconnected Bennett linkages 20, 32, 20.

Other, more complicated intermediate linkages are possible. For example, FIG. 20 illustrates an intermediate linkage 33 interconnected to Bennett linkages 20. In particular, the entire arrangement of the two interconnected Bennett linkages 20 and the intermediate linkage 33 is equivalent to the structural mechanism comprising two rows of two Bennett linkages 20 connected together in the same manner as illustrated in FIG. 7, but with links removed from two of the diametrically opposed Bennett linkages 20, so that the remaining complete Bennett linkages 20 are interconnected by the remaining portions of the Bennett linkages from which links are removed.

It should also be noted, that a given structural mechanism may be described in more than one manner. For example, the structural mechanism illustrated in FIG. 7 has been described as comprising the interconnected Bennett linkages 20 interconnected by intermediate Bennett linkages 23 and 27. This very same structural mechanism could equally have been described in terms of the intermediate Bennett linkages 27 along the minor direction N, which are aligned along rows 34, and the intermediate Bennett linkages 23, which are aligned along the rows 22, as being the "interconnected" Bennett linkages. In this case, the "intermediate" Bennett linkages are formed by the interconnected Bennett linkages 20.

In the structural mechanisms described above, the skew angles of each Bennett linkage 20 are the same. However, in general, the skew angles for the different rows 22 of Bennett linkages 20 along the minor direction N may be the same or different, provided that it is the same for all Bennett linkages 20 within any single row 22. The curvature of the profile of the structural mechanism along the minor direction N is therefore not necessarily circular. The curvature depends on the selected values of the skew angles and the lengths of the links 1 of the Bennett linkages 20 in each row 22. In particular, the relative rotation of the opposed pairs of links 1 and hence the curvature in the profile of the structural mechanism caused by a given Bennett linkage, increases as the magnitude of the skew angle increases. Thus, the degree of curvature may vary as one progresses along the minor direction N.

It will be noted that the structural mechanisms described above are over-constrained. Therefore, it is possible to remove one or more links for joints while retaining a single degree of mobility for the entire structural mechanism as a whole. Structural mechanisms which are based on Bennett linkages, but which have links or joints removed whilst retaining a single degree of mobility are within the scope of the present invention. In addition, this feature provides a particular advantage that failure of individual links or joints does not in itself result in failure of the structure as a whole. Thus, structural mechanisms in accordance with the present invention are particularly reliable.

Figure 21:
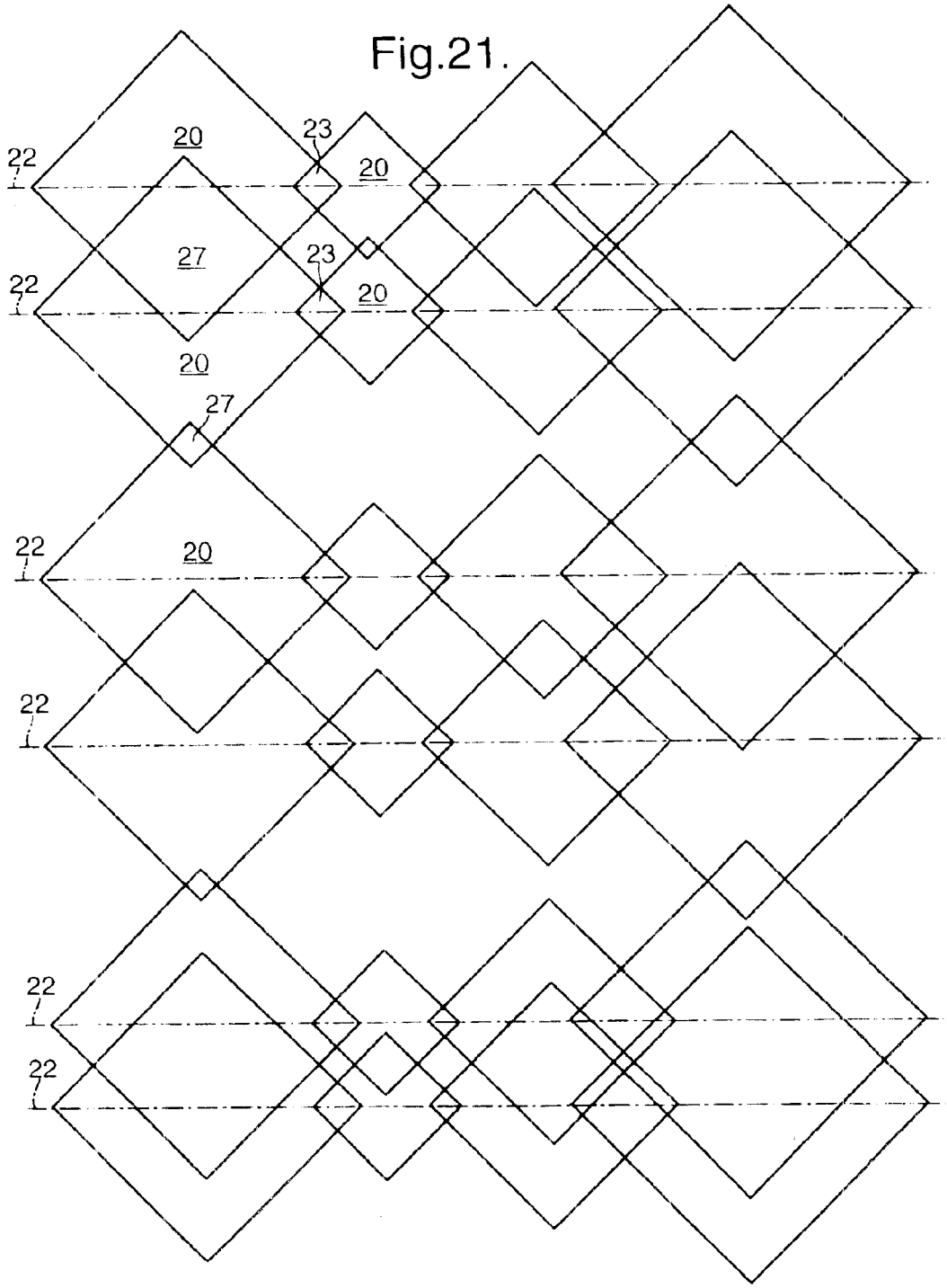
FIG. 21 is a schematic view of an alternative structural mechanism.

Also, the over-constrained nature of the structural mechanism means that it is not necessary to interconnect every adjacent pair of Bennett linkages 20. For example, FIG. 21 illustrates a structural mechanism similar to that illustrated in FIG. 7, except that between some of the rows 22 of Bennett linkages 20 along the major direction M, not all pairs of adjacent Bennett linkages 20 are connected along the minor direction N. For example, between the second and third rows 22, only the first and fourth Bennett linkages are connected along the minor direction N. FIG. 21 also illustrates how it is possible to vary the size of the individual Bennett linkages 20 relative to each other.

In addition to the structural mechanisms described above, deployable structures in accordance with the present invention may include additional constructional elements. These may or may not be mobile with the structural mechanism and may or may not introduce additional degrees of freedom or mobility. For example, such additional elements may be additional links connected to the structural mechanism described above by rotational joints to form an additional mechanism having a single degree of mobility with the structural mechanism described above. Alternatively, the additional structural elements may be unrelated to the structural mechanism.

One particularly desirable addition is some mechanism for limiting the movement of the structural mechanism beyond the deployed state to hold the mechanism in the deployed state. For example, such limiting means may be formed by flexible elements wires attached between opposed pairs of links 1 or joints 2 which move apart during movement from the undeployed state to the deployed state, so that the flexible elements are held in tension in the deployed state, preventing further movement. Alternatively, the structural mechanism may be held in its deployed state by entirely separate means which are attached to the structural mechanism after deployment.

Figure 22:
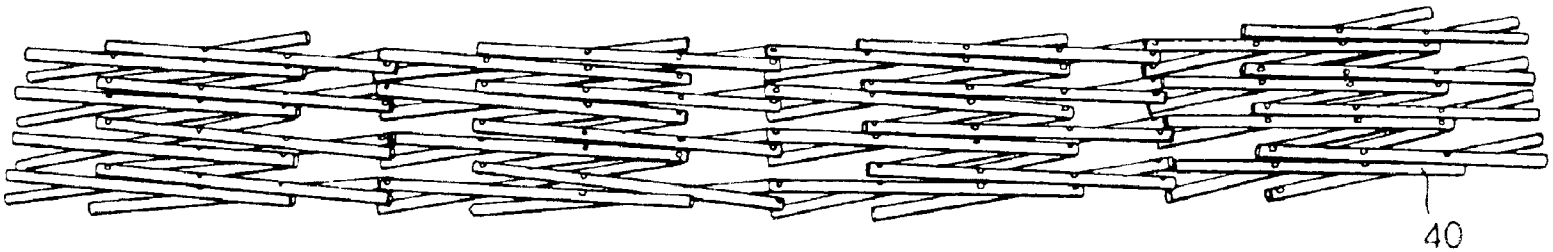
FIG. 22 is a perspective view of a structural mechanism in its flat state.
Figure 24:
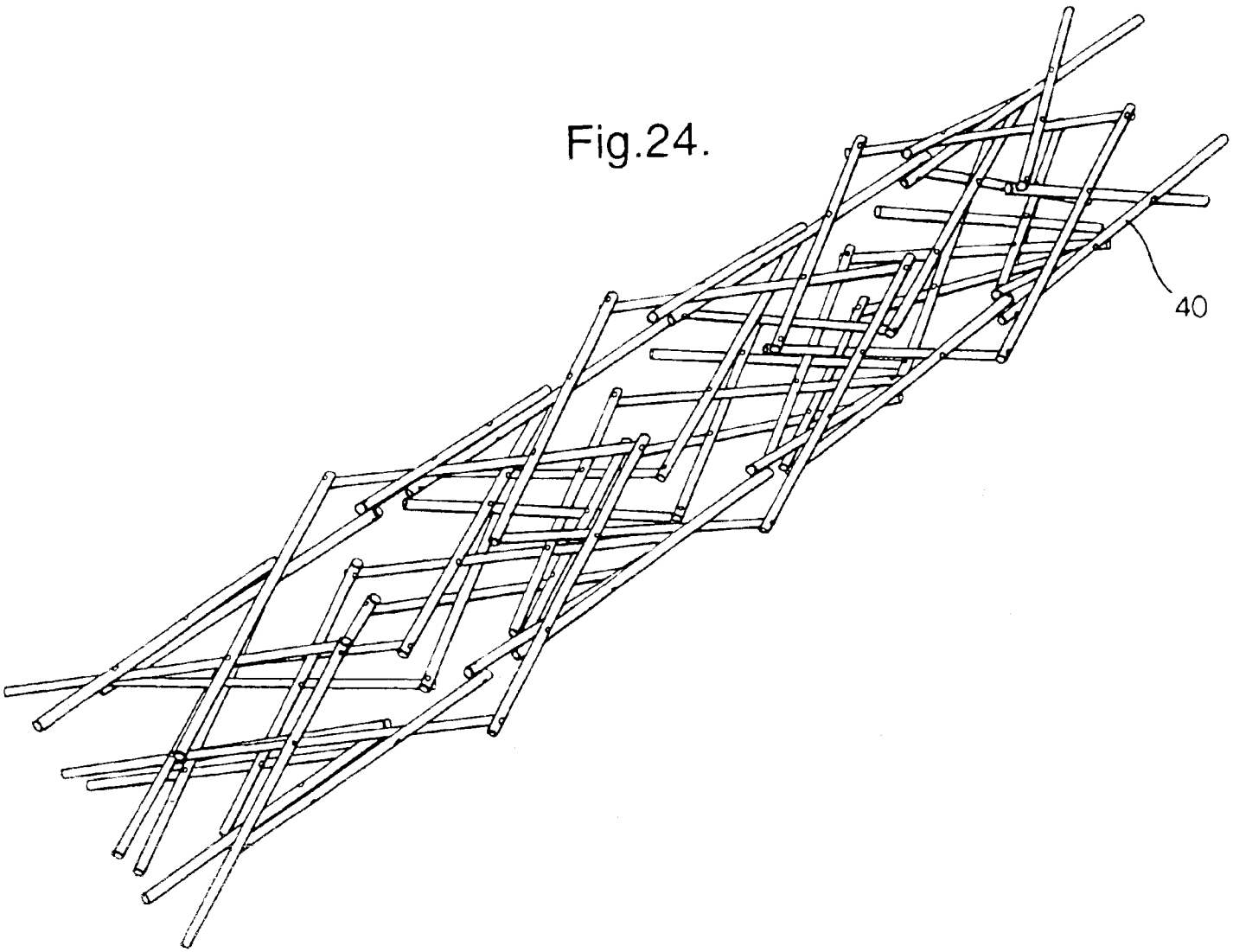

FIGS. 22 to 24 illustrate deployment of an actual structural mechanism 40 which has the same form as the structural mechanism illustrated in FIG. 7. In particular, in the structural mechanism 40 of FIGS. 22 to 24; each of the interconnected Bennett linkages 20 is equilateral and of identical size; each of the intermediate linkages 23 along the major direction M and each of the intermediate Bennett linkages 27 along the minor direction N are of the same size; and the skew angles of each Bennett linkage in the structural mechanism 40 are identical and approximately equal to 30° (or 120°). FIG. 22 illustrates the structural mechanism 40 in a flat state in which its profile is straight along both the minor direction N and the major direction M. On movement of the structural mechanism 30, the profile along the minor direction N curves with an increasing degree of curvature as illustrated in FIGS. 23 and 24. The profile along the major direction M remains straight. As shown in FIG. 23, the structural mechanism 40 is movable into a state in which it forms a generally cylindrically arch. As shown in FIG. 24, the structural mechanism 40 can reach a further state in which the edges of the structural mechanism 40 along the minor direction N meet one another to give the mechanism 40 a cylindrical shape. In both cases, the structural mechanism defines an internal volume around which, the structural mechanism forms an open frame as can be seen by comparing FIG. 22 with either of FIGS. 23 and 24.

The structural mechanism in its flat state illustrated in FIG. 22 has a very compact form. This property makes the structural mechanism particularly useful as a deployable structure. The flat state of the structural mechanism, for example as illustrated in FIG. 22, may be taken as the undeployed state. Any of the curved states, for example those illustrated in FIGS. 23 or 24, or other states in between, are used as the deployed state. The structure is deployed by movement of the structural mechanism.

The structural mechanism may be used as a deployable structure in a wide range of engineering applications and may have any size. It may be very small, limited only by the ability to produce a rotational joint. Equally, the structural mechanism may be very large, for example in aerospace applications. In all such applications, the present invention provides the advantages described above.

Figure 25:
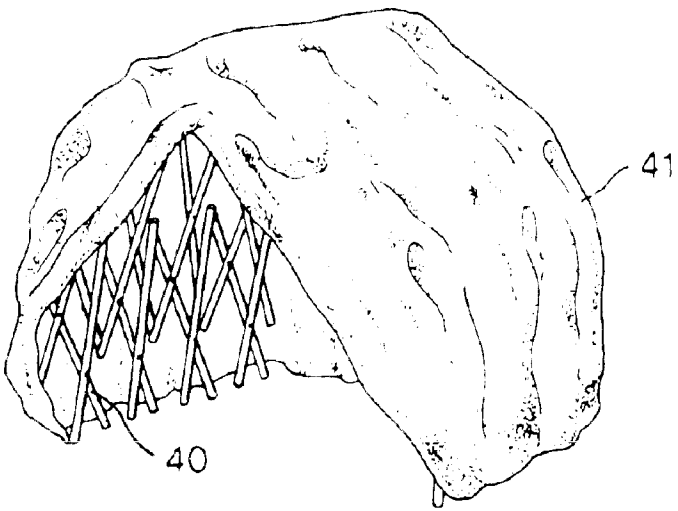
FIG. 25 is a view of the structural mechanism of FIG. 22 used as a tent.

A particularly useful application is as the frame for a tent in which the structural mechanism, in its deployed state, supports flexible material. FIG. 25 illustrates such a tent formed by the structural mechanism 40 illustrated in FIG. 23 covered by a sheet 41 of flexible material.

Although a tent could be formed simply by draping a sheet of flexible material over the structural mechanism, preferably a flexible material is formed from a number of panels attached together so that the flexible material conforms with the shape of the structural mechanism in its deployed state. The panels of flexible material may be attached together using techniques which are conventional for known tents, for example by sewing the panels together along a seam.

The flexible material may be attached to the frame using any type of fastening. For example, the fastening may be formed simply by ties attached to the flexible material at suitable positions for being tied around links of the structural mechanism. Alternatively, the fastenings may be formed by clips. Indeed, any type of fastening which is conventional for attaching the flexible material to the frame of a known tent may be applied.

The flexible material may be of any suitable form. For example, it may be a fabric made from natural or man-made materials. Alternatively, it may be material which is manufactured as a sheet. In general, any type of flexible material which is known for use in a tent may be applied.

The flexible material may be formed as a single piece or plural pieces. Generally, the flexible material is arranged over the structural mechanism after deployment of the structural mechanism. It would not be desirable for a single sheet of flexible material to be attached over the entire structural mechanism prior to deployment, because the dimensions of the structural mechanism along the minor direction N decrease during deployment of the structural mechanism. Therefore, if the material were attached at two positions separated along the minor direction N in the flat state, then this would result in the formation of flaps of material during deployment. To avoid this problem it is possible to attach the, or each piece of the flexible material to the structural mechanism only at positions aligned along the major direction M. When using plural pieces of flexible material, those pieces will then move together during deployment of the structural mechanism to cover it in the deployed state. Then, the individual pieces of flexible material may be attached together or to the structural mechanism using any suitable form of fastening.

The present invention may be applied to tents of any size. This includes both small tents designed to accommodate one or a few individuals, for example for camping. On the other hand, the size of the tents may extend up to very large structures capable of accommodating large numbers of people or equipment, e.g. helicopters or planes.

When the deployable structure in accordance with the present invention is used as the frame for a tent, it provides all the advantages described above for the present invention in general. For a tent, the ability to easily and rapidly deploy the structure provides particular advantage.

What is claimed is:

1. A deployable structure including a structural mechanism consisting of a plurality of rigid links connected together by rotational joints, each joint connecting two links and providing for rotation of the connected links relative to each other about a respective axis of rotation, to form an array of Bennett linkages, wherein:

each Bennett linkage comprises four links connected in a loop by rotational joints, wherein the axes of rotation of the joints connecting each link are skewed relative to each other around an imaginary line perpendicular to the axes of rotation of both joints by a skew angle, where, measuring the skew angles for each link in the same sense around the Bennett linkage, the skew angles for opposite links are equal, defining the length of a link as the length between the joints connecting that link resolved along said imaginary line, the lengths of opposite links are equal, and the length a of a first pair of opposite links, the length b of the second pair of opposite links, the skew angle $\alpha$ for the first pair of opposite links, and the skew angle $\beta$ for the second pair of opposite links are related by the formula:

$$a/b=\sin\alpha/\sin\beta;$$

the ratio of the lengths of the first and second pairs of opposite links is the same for each Bennett linkage;

Bennett linkages are arranged in a common orientation in a series of rows along which rows the Bennett linkages are aligned in parallel directions;

within each row, the Bennett linkages have equal skew angles for corresponding links;

respective pairs of Bennett linkages in their rows are interconnected by two connected links of one of the interconnected Bennett linkages being connected by respective rotational joints to a respective one of two connected links of the other of the interconnected Bennett linkages so that said two connected links of each of the interconnected Bennett linkages are connected in a loop to form an intermediate Bennett linkage, each respective intermediate Bennett linkage being either:

(a) arranged inside the interconnected Bennett linkages and having skew angles which are equal to the corresponding skew angles of the interconnected Bennett linkages; or (b) arranged outside the interconnected Bennett linkages and having skew angles which are equal to 180° minus the corresponding skew angles of the interconnected Bennett linkages; and respective pairs of Bennett linkages in adjacent rows are interconnected by two connected links of one of the interconnected Bennett linkages being connected by respective rotational joints to a respective one of two connected links of the other of the interconnected Bennett linkages so that said two connected links of each of the interconnected Bennett linkages are connected in a loop to form an intermediate linkage which is either:

(a) a linkage in which the joints all have parallel axes of rotation and, defining the length of a link as the length between the joints connecting that link resolved along an imaginary line perpendicular to the axes of rotation of the joints connecting the link the lengths of opposite links is equal; or (b) a Bennett linkage which is either:

(b1) arranged inside the interconnected Bennett linkages and has skew angles which are not equal to the corresponding skew angles of the interconnected Bennett linkages; or (b2) arranged outside the interconnected Bennett linkages and has skew angles which are not equal to 180° minus the corresponding skew angles of the interconnected Bennett linkages.

2. A deployable structure according to claim 1, wherein each respective joint is formed in each respective link it connects at the intersection of the axis of rotation of the respective joint with an imaginary line perpendicular to both the axis of rotation of the respective joint and the axis of rotation of the adjacent joints in the Bennett linkage.

3. A deployable structure according to claim 2, wherein each respective link is straight and perpendicular to the axes of rotation of the joints connecting the respective link.

4. A tent comprising a deployable structure according to claim 1, in combination with flexible material arranged to cover the structural mechanism when the structural mechanism is in a deployed state.

5. A deployable structure including a structural mechanism consisting of a plurality of rigid links connected together by rotational joints, each joint connecting two links and providing for rotation of the connected links relative to each other about a respective axis of rotation, to form an array of Bennett linkages, wherein each Bennett linkage comprises four links connected in a loop by rotational joints each connecting two links and providing for rotation of the connected links relative to each other about a respective axis of rotation, wherein the axes of rotation of the joints connecting each link are skewed relative to each other around an imaginary line perpendicular to the axes of rotation of both joints by a skew angle, where, measuring the skew angles for each link in the same sense around the Bennett linkage, the skew angles for opposite links are equal, defining the length of a link as the length between the joints connecting that link resolved along said imaginary line, the lengths of opposite links are equal, and the length a of a first pair of opposite links, the length b of the second pair of opposite links, the skew angle $\alpha$ for the first pair of opposite links, and the skew angle $\beta$ for the second pair of opposite links are related by the formula:

$$a/b=\sin\alpha/\sin\beta;$$

the ratio of the lengths of the first and second pairs of opposite links is the same for each Bennett linkage;

Bennett linkages are arranged in series in a common orientation;

respective pairs of Bennett linkages which are adjacent in said series are interconnected by two connected links of one of the interconnected Bennett linkages being connected by respective rotational joints to a respective one of two connected links of the other of the interconnected Bennett linkages so that said two connected links of each of the interconnected Bennett linkages are connected in a loop to form an intermediate linkage which is either:

(a) a linkage in which the joints all have parallel axes of rotation and, defining the length of a link as the length between the joints connecting that link resolved along an imaginary line perpendicular to the axes of rotation of the joints connecting the link, the lengths of opposite links is equal; or (b) a Bennett linkage which is either:

(b1) arranged inside the interconnected Bennett linkages and has skew angles which are not equal to the corresponding skew angles of the interconnected Bennett linkages; or (b2) arranged outside the interconnected Bennett linkages and has skew angles which are not equal to 180° minus the corresponding skew angles of the interconnected Bennett linkages.

6. A tent comprising a deployable structure according to claim 5, in combination with flexible material arranged to cover the structural mechanism when the structural mechanism is in a deployed state.

7. A deployable structure according to claim 5, wherein the intermediate linkages include Bennett linkages in which each either:

is arranged inside the interconnected Bennett linkages and has skew angles which are of opposite sign to the corresponding skew angles of the interconnected Bennett linkages; or is arranged outside the interconnected Bennett linkages and has skew angles which are of the same sign as the corresponding skew angles of the interconnected Bennett linkages.

8. A deployable structure according to claim 5, wherein each respective joint is formed in each respective link it connects at the intersection of the axis of rotation of the respective joint with an imaginary line perpendicular to both the axis of rotation of the respective joint and the axis of rotation of the adjacent joints in the Bennett linkage.

9. A deployable structure according to claim 8, wherein each respective link is straight and perpendicular to the axes of rotation of the joints connecting the respective link.

10. A deployable structure including a structural mechanism consisting of a plurality of rigid links connected together by rotational joints, each joint connecting two links and providing for rotation of the connected links relative to each other about a respective axis of rotation, to form an array of Bennett linkages, wherein:

each Bennett linkage comprises four links connected in a loop by rotational joints each connecting two links and providing for rotation of the connected links relative to each other about a respective axis of rotation, wherein the axes of rotation of the joints connecting each link are skewed relative to each other around an imaginary line perpendicular to the axes of rotation of both joints by a skew angle, where, measuring the skew angles for each link in the same sense around the Bennett linkage, the skew angles for opposite links are equal, defining the length of a link as the length between the joints connecting that link resolved along said imaginary line, the lengths of opposite links are equal, and the length a of a first pair of opposite links, the length b of the other pair of opposite links, the skew angle $\alpha$ for the first pair of opposite links, and the skew angle $\beta$ for the second pair of opposite links are related by the formula:

$$a/b=\sin\alpha/\sin\beta;$$

the ratio of the lengths of the first and second pairs of opposite links is the same for each Bennett linkage;

the array of Bennett linkages includes a series of Bennett linkages arranged in series in a common orientation and having equal skew angles for corresponding links;

respective pairs of Bennett linkages which are adjacent in said series being interconnected by an intermediate linkage which has a single degree of mobility and is mobile with both the interconnected Bennett linkages.

11. A deployable structure according to claim 10, wherein the intermediate linkage is formed by two connected links of one of the interconnected Bennett linkages being connected by respective rotational joints to a respective one of two connected links of the other of the interconnected Bennett linkages so that said two connected links of each of the interconnected Bennett linkages are connected in a loop.

12. A deployable structure according to claim 11, wherein the intermediate linkage is a linkage in which the joints all have parallel axes of rotation and, defining the length of a link as the length between the joints connecting that link resolved along an imaginary line perpendicular to the axes of rotation of the joints connecting the link, the lengths of opposite links are equal.

13. A deployable structure according to claim 11, wherein the intermediate linkage is a Bennett linkage.

14. A deployable structure according to claim 13, wherein the intermediate Bennett linkage is arranged inside the interconnected Bennett linkages and has skew angles which are not equal to the corresponding skew angles of the interconnected Bennett linkages.

15. A deployable structure according to claim 13, wherein the intermediate Bennett linkage is arranged outside the interconnected Bennett linkages and has skew angles which are not equal to 180° minus the corresponding skew angles of the interconnected Bennett linkages.

16. A deployable structure according to claim 10, wherein the array of Bennett linkages includes a series of rows of Bennett linkages all in a common orientation and having equal skew angles for corresponding links, the Bennett linkages in each row being aligned along a direction which is parallel for each row, respective pairs of Bennett linkages which are adjacent in said row being interconnected by an intermediate linkage which has a single degree of mobility and is mobile with both the interconnected Bennett linkages.

17. A deployable structure according to claim 16, wherein said intermediate linkage is formed by two connected links of one of the interconnected Bennett linkages being connected by respective rotational joints to a respective one of two connected links of the other of the interconnected Bennett linkages so that said two connected links of each of the interconnected Bennett linkages are connected in a loop to form an intermediate Bennett linkage.

18. A deployable structure according to claim 17, wherein the intermediate Bennett linkage is arranged inside the interconnected Bennett linkages and has skew angles which are equal to the corresponding skew angles of the interconnected Bennett linkages.

19. A deployable structure according to claim 17, wherein the intermediate Bennett linkage is arranged outside the interconnected Bennett linkages and having skew angles which are equal to 180° minus the corresponding skew angles of the interconnected Bennett linkages.

20. A deployable structure according to claim 10, wherein each respective joint is formed in each respective link it connects at the intersection of the axis of rotation of the respective joint with an imaginary line perpendicular to both the axis of rotation of the respective joint and the axis of rotation of the adjacent joints in the Bennett linkage.

21. A deployable structure according to claim 20, wherein each respective link is straight and perpendicular to the axes of rotation of the joints connecting the respective link.

22. A tent comprising a deployable structure according to claim 10, in combination with flexible material arranged to cover the structural mechanism when the structural mechanism is in a deployed state.

* * * * *